US005395273A

United States Patent [19]

Matsutani

[11] Patent Number: 5,395,273

[45] Date of Patent: Mar. 7, 1995

[54] METHOD OF MAKING A GROUND ELECTRODE FOR A SPARK PLUG

[75] Inventor: Wataru Matsutani, Nagoya, Japan

[73] Assignee: NGK Spark Plug Co., Ltd., Nagoya, Japan

[21] Appl. No.: 118,623

[22] Filed: Sep. 10, 1993

[30] Foreign Application Priority Data

Sep. 10, 1992 [JP] Japan ..... 4-242179

[51] Int. Cl.[6] ..... H01T 21/02

[52] U.S. Cl. ..... 445/7; 219/121.64

[58] Field of Search ..... 445/7, 46; 123/169 EL; 219/121.64; 313/141

[56] References Cited

U.S. PATENT DOCUMENTS

| | | | |
|---|---|---|---|
| 4,699,600 | 10/1987 | Kondo | 445/7 |
| 4,771,210 | 9/1988 | Möhle et al. | 445/7 |
| 4,786,267 | 11/1988 | Toya et al. | 445/7 |
| 4,963,112 | 10/1990 | Benedikt et al. | 219/121.64 |
| 5,273,474 | 12/1993 | Oshima et al. | 219/121.64 |

FOREIGN PATENT DOCUMENTS

| | | |
|---|---|---|
| 57-151183 | 9/1982 | Japan . |
| 63-57919 | 11/1988 | Japan . |
| 249388 | 2/1990 | Japan . |
| 2500704 | 3/1990 | Japan . |

*Primary Examiner*—P. Austin Bradley
*Assistant Examiner*—Jeffrey T. Knapp
*Attorney, Agent, or Firm*—Sughrue, Mion, Zinn, Macpeak & Seas

[57] ABSTRACT

In a method of making a spark plug electrode, an electrode blank is prepared to have a firing portion at one end of the electrode blank. A recess is provided at the firing portion of the electrode blank. A noble metal material is placed in the recess. Laser beams are applied on the noble metal material in the recess to melt 70%~100% by weight of the noble metal material to form a noble metal tip. A component of the electrode blank is formed from a clad metal wherein the clad metal is thermally fused to the noble metal tip to form a fused portion, such that the clad metal comprises 0.5%~80% of the total weight of the fused portion.

7 Claims, 6 Drawing Sheets

METHOD OF MAKING A GROUND ELECTRODE FOR A SPARK PLUG

BACKGROUND THE INVENTION

1. Field of the Invention

This invention relates to a method of making a spark plug electrode in which a spark-erosion resistant noble metal is secured to a firing portion of an electrode blank.

2. Description of Prior Art

In a spark plug for an internal combustion engine, it has been suggested that a noble metal tip is laser-welded to a curved or flat-shaped firing end of an electrode so as to increase a spark-erosion resistant property.

However, the laser beams causes to spherically swell the metal tip from the base of the firing portion. The swollen portion of the noble metal tip differes in height and position depending on the spark plug produced. For this reason, the noble metal tip comes to oppose another electrode out of normal place so as to change a spark gap interval, thus making it difficult to discharge the spark along the spark GaP. At the same time, the swollen portion of the noble metal tip interferes with an insulator when the electrode is placed within the insulator.

Therefore, it is one of the objects of the invention to provide a method of making a spark plug electrode in which a noble metal material is placed in a recess of a firing portion, and melted by means of laser beams only so as to form a noble metal portion, and thus maintaining the noble metal portion substantially in flush with the firing portion without protracting out of the recess, and contributing to an extended service life with relatively low cost.

SUMMARY OF THE INVENTION

According to the invention, there is provided a method of making a spark plug electrode, a recess is provided at the firing portion of the electrode blank. A noble metal material is placed in the recess, volume of which is substantially corresponding to that of the noble metal material. Then, laser beams are applied on the noble metal material in the recess to melt the noble metal material in the range of 70%~100% by weight to form a noble metal tip. In this instance, a component of the electrode blank is thermally fused into the noble metal tip in the range of 0.5%~80.0% by weight.

The method is such that the noble metal portion is substantially flush with the firing portion without protracting out the recess when the noble metal material is melted by the laser beams. This makes it possible to maintain a uniform spark gap interval upon putting it to mass production.

These and other objects and advantages of the invention will be apparent upon reference to the following specification, attendant claims and drawings.

Figure 1:
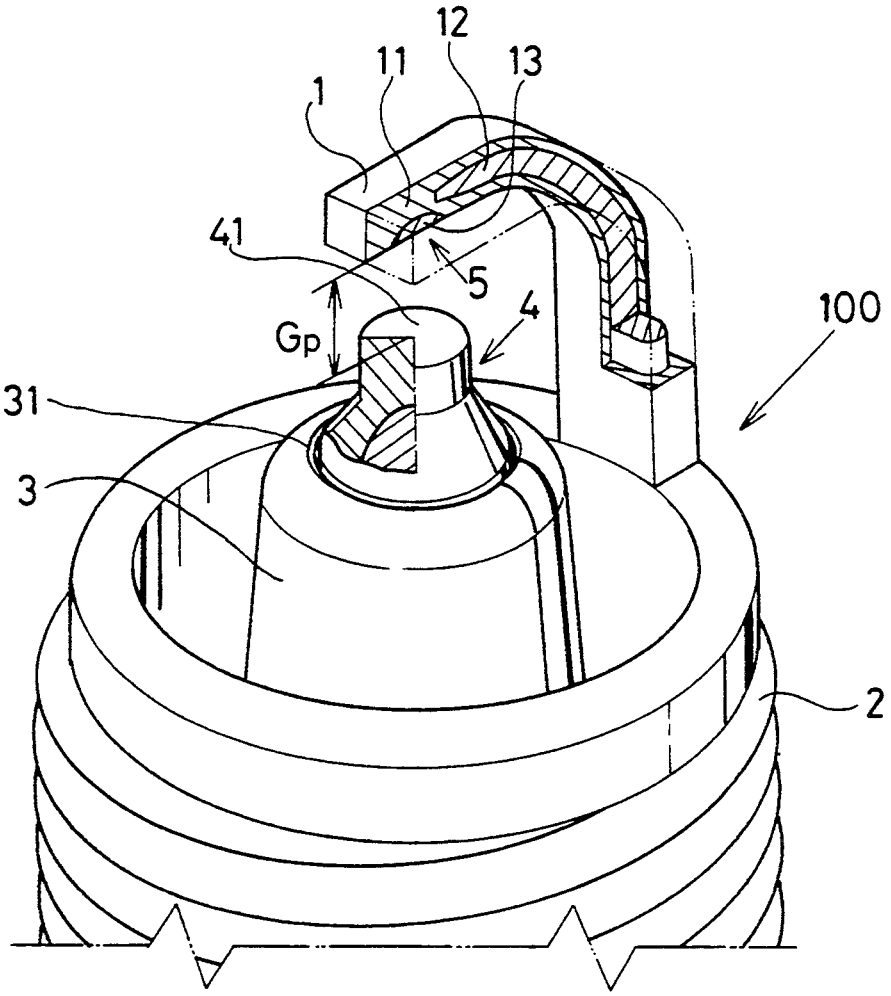
FIG. 1 is a perspective view of a firing end of spark plug, but its electrodes are partly sectioned according to a first embodiment of the invention.
Figure 3:
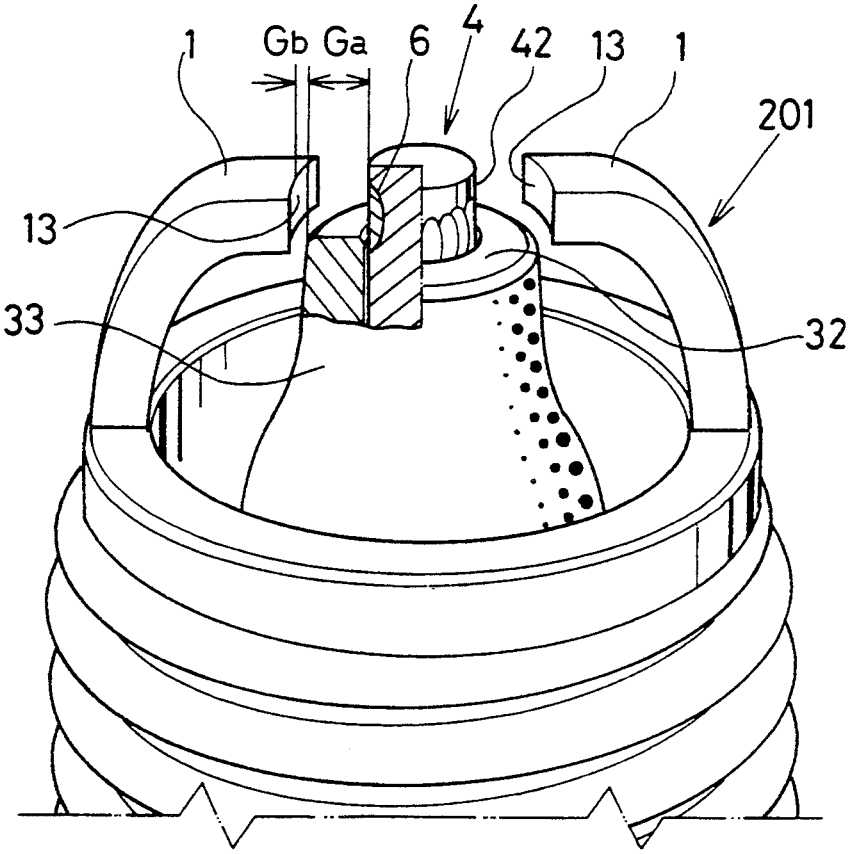
Figure 5:
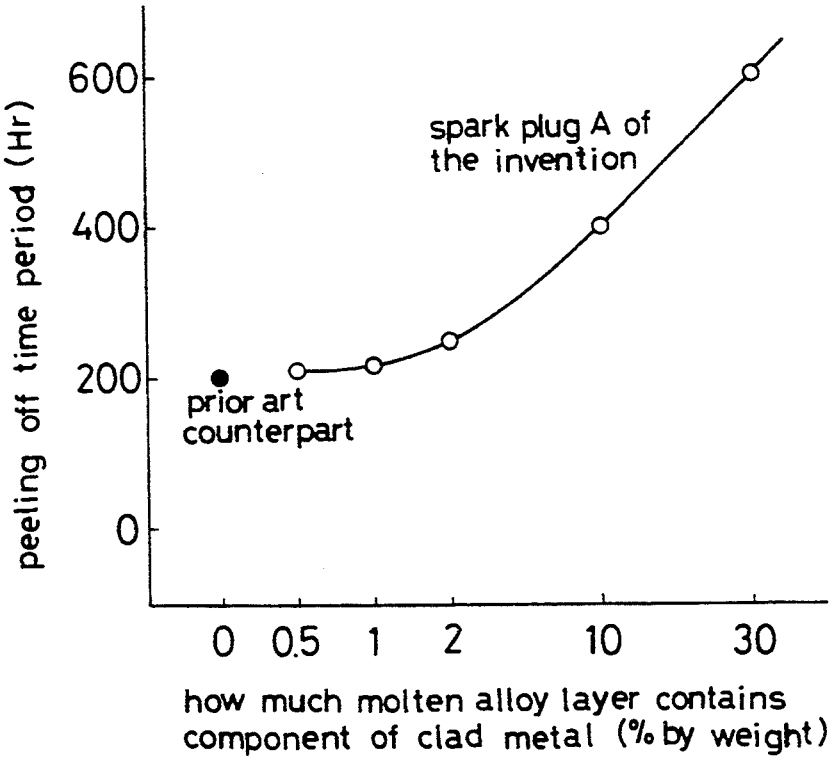
Figure 6:
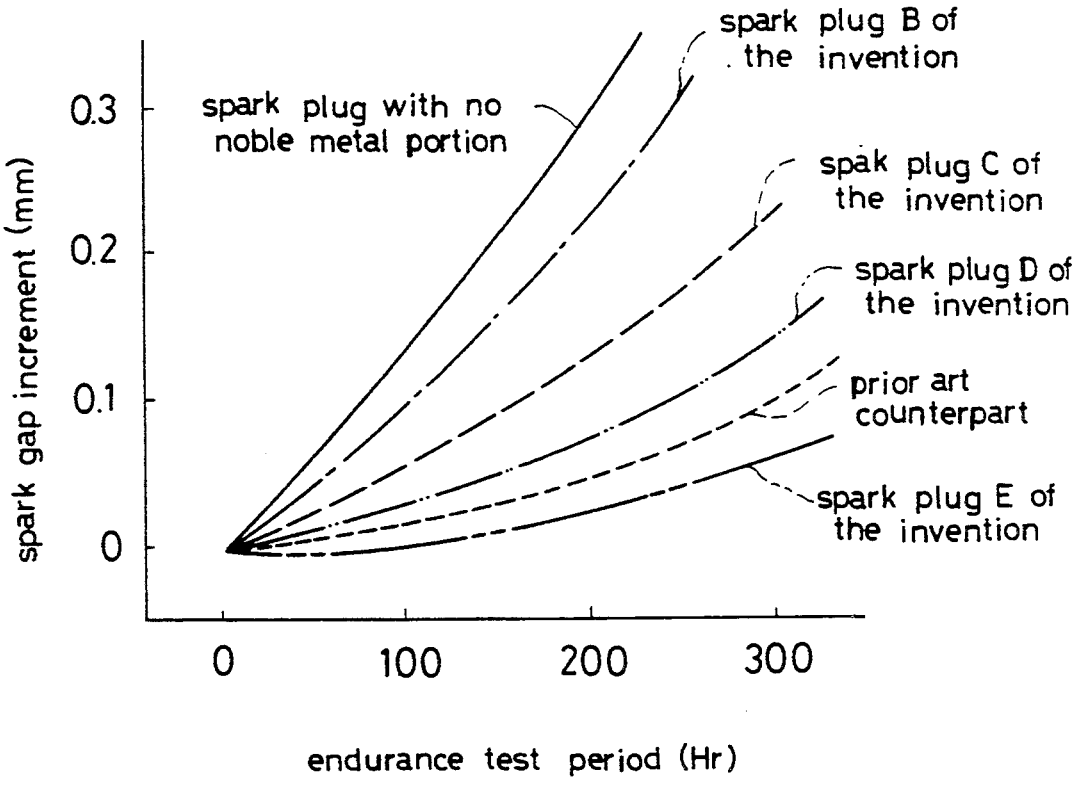

FIG. *2a*~*2c* are views of making processes of a spark plug electrode;

FIG. 3 is a perspective view similar to FIG. 1 according to a second embodiment of the invention;

FIGS. *4a*~*4c* are views of making process similar to FIG. 1 according to the second embodiment of the invention;

FIG. 5 is a graph showing how an endurance time period changes depending on how much the center electrode is melt into the noble metal portion; and FIG. 6 is a graph showing how a spark gap increment changes depending on how much the center electrode is melt into the noble metal portion with the passage of service time period.

DETAILED DESCRIPTION OF THE EMBODIMENTS

Referring to FIG. 1 which shows a spark plug 100 according to first embodiment of the invention, the spark plug 100 has a cylindrical metallic shell 2, to a front end of which a ground electrode 1 is secured by means of welding. Within the metallic shell 2, a tubullar insulator 3 is fixedly supported. An inner space of the insulator 3 serves as an axial bore 31 in which a center electrode 4 is placed, a front end 41 of which 4 extends somewhat beyond a front end of the insulator 3 so as to form a spark gap (Gp) with the ground electrode 1 through a noble metal portion 5 described hereinafter in detail.

The ground electrode 1 has a composite plate including a clad metal 11 and a heat-conductive core 12 embedded in the clad metal 11. The clad metal 11 is made of a nickel-based alloy (Inconel 600) including iron (Fe) and chromium (Cr), while the heat-conductive core 12 is made of an alloyed metal with a copper (Cu) or saver (Ag) as a main component. The clad metal 11 may be made of nickel-based alloy containing silicon (Si), manganese (Mn) and chromium (Cr).

With a firing portion 13 of the clad metal 11 of the ground electrode 1, a noble metal portion 5 is provided to be substantially flush with an curer surface of the ground electrode 1.

The noble metal portion 5 is made of a noble metal material 50 such as platinum (Pt), iridium (It), Pt-It alloy, Pt-Ni alloy or Ir-alloy containing oxides of rare earth metals.

The noble metal portion 5 is welded to the ground electrode 1 as follows:

(i) The oblong composite plate 1*a* is prepared to have the firing portion 13 at an upper surface of the clad metal 11 as shown in FIG. *2a*. Then, a circular recess 14 is provided on a flat surface of the firing portion 13 by a press pin (not shown). The recess 14 measures 0.9 mm in diameter and 0.1 mm in depth, and the volume of the recess 14 generally corresponds to that of the noble metal material 50.

In this instance, the noble metal material 50 is in the form of disc-shaped configuration measuring 0.9 mm in diameter and 0.2 mm in thickness.

(ii) Upon forming the noble metal portion 5, the noble metal material 50 is concentrically placed within the recess 14, and laser beams (L) are applied on the noble metal material 50 to melt it in the recess 24 in the range of 70~100% by weight as shown in FIG. *2b*.

In this instance, the laser beam welding is carried out by using YAG (yttrium, aluminum and garnet) laser beams (L) emitting four shots at 10 mm underfocus (1 pps) with one shot energy and pulse duration as ? .0 Joules and 2.0 milliseconds respectively.

Figure 2A:
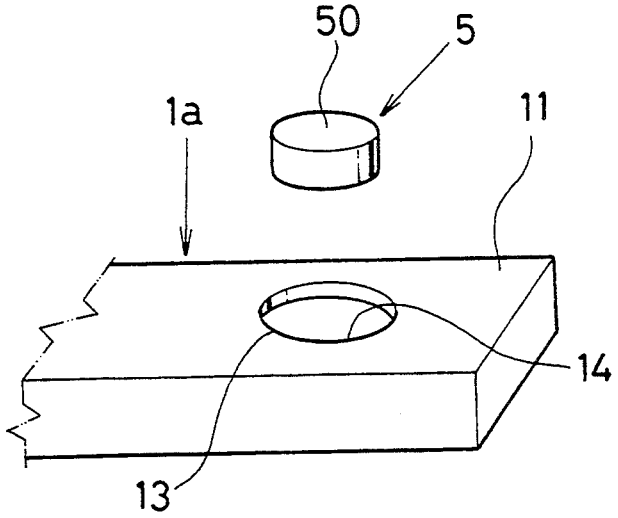
Figure 2B:
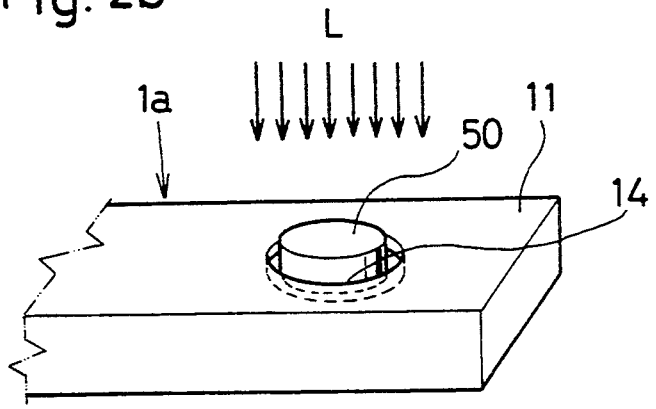
Figure 2C:
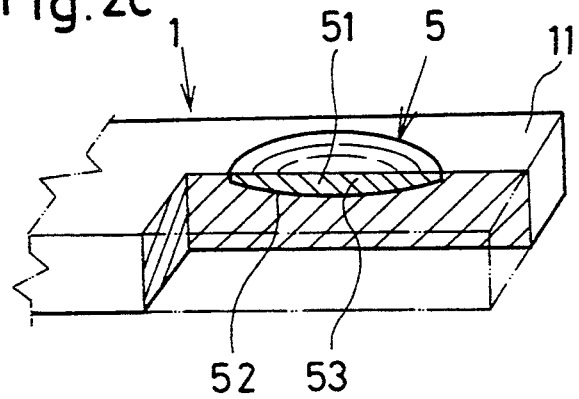

Upon melting the noble metal material 50 more than 70% by weight, a molten alloy layer 51 is formed in which a component of the clad metal 11 is thermally fused into the noble metal material 50 in the range of 0.5~80.0% by weight as shown in FIG. 2*c*. A diffused alloy layer 52 is formed between a molten alloy layer 51 and the firing portion 13 of the clad metal 11, and a depth of the diffused alloy layer 52 extends from several μm to several hundred μm. In order to improve the performance of the spark plug, it is found necessary that the noble metal component contained in the tip exceeds 70% by weight. In this instance, the noble metal material 50 may be in the form of powder, it is necessary to completely melt the noble metal powder by 100% by weight.

In the diffused alloy layer 52, the diffused degree of the noble metal progressively decreases as the layer 52 is away from a base end 53 of the molten alloy layer 51. The component of the clad metal 53 is thermally fused into the base end 53 of the molten alloy layer 51 so that the thermal expansional coefficient of the base end 53 approaches to that of the clad metal 11. With the formation of the diffused alloy layer 52 and the base end 53 of the molten alloy layer 51, it is possible to prevent the thermal stress from locally working on the welded portion when the ground electrode is exposed to the repeated heat-cool cycle. It also decreases the thermal stress itself by reducing the differing degree of the thermal expansional coefficient in the direction from the welded portion to the clad metal 11. This makes it possible to prevent the growth of cracks at the welded portion or in the proximity of the welded portion so as to avoid the molten alloy layer 51 from peeling off the clad metal 11 of the ground electrode 1.

FIG. 3 shows a second embodiment of the invention in which a surface discharge gap (Ga) and an air gap (Gb) are provided in a semi-surface-discharge type spark plug 201. A ring-shaped noble metal material 60 is laser-welded to an outer side wall 42 of a front end of the center electrode 4 so as to provide a noble metal portion 6. The surface discharge gap (Ga) is a distance measured along the discharge surface 32 between the noble metal portion 6 and an outer surface 33 of the insulator 3. The air gap (Gb) is a distance between the firing end 13 of the ground electrode 1 and the outer surface 33 of the insulator 3 as shown in FIG. 3.

Figure 4C:
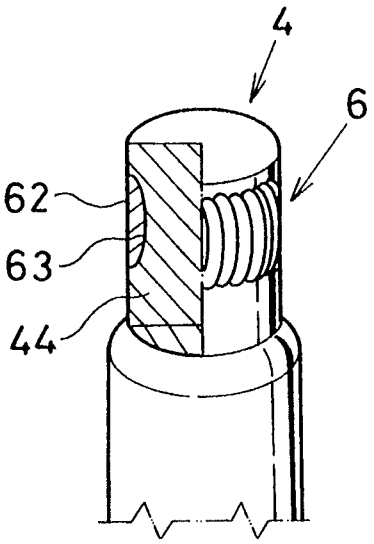
Figure 4B:
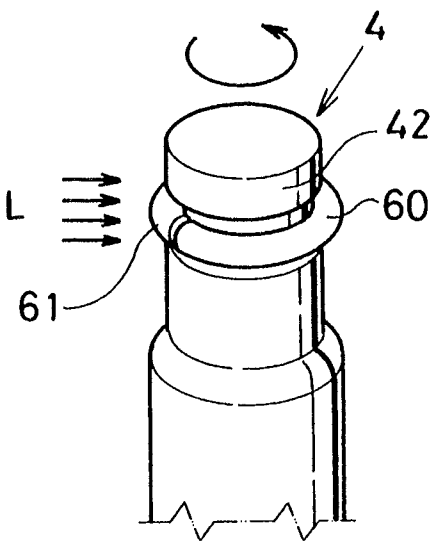
Figure 4A:
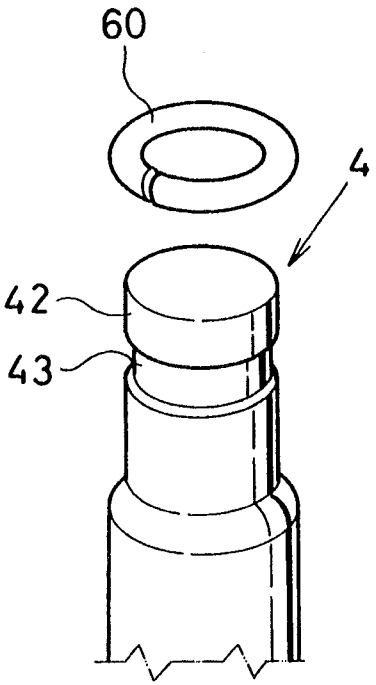

According to the second embodiment of the invention, the center electrode is made as follows:

(i) By using a cutter, an annular recess 43 is provided with a side wall 42 of a front portion of the center electrode 4 as shown in FIG. 4*a*. The recess 43 measures 0.6 mm in width and 0.1 mm in depth, and the volume of the recess 43 generally corresponds to that of the noble metal material 60. In this instance, the material 60 is made by circularly bending a noble metal wire of 0.3 mm in diameter.

(ii) The noble metal ring 60 is placed in the recess 43, and the laser beams (L) are applied perpendicular to an outer surface 61 of the noble metal ring 60 as shown in FIG. 4*b*.

In this instance, the laser beam welding is carried out by using YAG (yttrium, aluminum and garnet) laser beams (L) emitting forty-eight shots at 11 mm underfocus (5 pps) with one shot energy and pulse duration as 7.5 Joules and 2.0 milliseconds, respectively, emitting forty-eight shots at 11 mm underfocus (5 pps) with one shot energy and pulse duration as 7.5 Joules and 2.0 millseconds, respectively, emitting thirty-six shots at 2 mm center electrode diameter and just focus (12 pps) with one shot energy and pulse duration as 5 to 6 Joules and 2.0 milliseconds respectively, and emitting forty-eight shots at 2.5 mm center electrode diameter and just focus (14 pps) with one shot energy and pulse duration as 5.5 to 6.5 Joules and 2.0 milliseconds respectively. During the laser beam welding operation, the center electrode 4 is rotated at the speed of $5\pi/6$ rad/sec so as to emit the laser beams (L) all through the circumferential length of the noble metal ring 60. Instead of the noble metal ring 60, a straight wire may be used so that the leading end of the wire is placed in the recess 43, and the center electrode 4 is rotated while applying the laser beams (L) consecutively from the leading end to the successive portion of the wire.

Upon melting the noble metal ring more than 70% by weight, a molten alloy layer 62 is formed in which a component of a clad metal 44 of the center electrode 4 is thermally fused into the noble metal ring 60 in the range of 0.5~80.0% by weight as shown in FIG. 4*c*. A diffused alloy layer 62 is formed between the molten alloy layer 62 and the clad metal 44 of the center electrode 4, and a depth of the diffused alloy layer 52 extends from several μm to several hundreds μm. This makes it possible to prevent the growth of cracks at the welded portion or in the neighborhood of the welded portion so as to avoid the molten alloy layer 62 from inadvertently peeling off the clad metal 44 of the center electrode 4.

FIG. 5 is a graph showing how many hours are required for the noble metal portion 6 to peel off the clad metal 44 depending on how much the molten layer 62 contains the component of the clad metal 44. The graph is obtained after carrying out an endurance heat-cool cycle alternately between a full throttle (5000 rpm) for 1 min. and an idle operation for 1 min. with the spark plug (A) and a prior art counterpart mounted on an internal combustion engine (six-cylinder, 2000 cc) respectively. In the prior art counterpart, a noble metal portion is provided by means of electric resistance welding.

It is found from FIG. 5 that it takes much longer for the noble metal portion 6 to peel off the side wall 42 of the center electrode 4 compared to prior art counterpart when the molten alloy layer 62 contains the component of the clad metal 44 more than 0.5% by weight.

FIG. 6 is a graph showing how the spark Gap increment changes depending on how much the molten layer 62 contains the component of the clad metal 44. The Graph is obtained after carrying out an endurance test at full throttle (5500 rpm) with spark plugs (B)~(E) mounted on an internal combustion engine (four-cylinder, 1600 cc) respectively.

In the spark plugs (B)~(E), the molten alloy layer 62 in turn contains the component of the clad metal 44 by 90%, 80%, 20% and 10% by weight.

It is found from the endurance test that the spark GaP increment augments to accelerate the spark erosion of the clad metal 44 when the molten alloy layer 62 contains the component of the clad metal 44 excessively.

Although a relatively small amount of the spark erosion is maintained in the prior art counterpart in which the noble metal tip is provided by means of electric resistance welding, it is possible to control the spark erosion by selecting the kind of the noble metal material 6 and the shooting condition of the laser beams (L) as shown at the spark plug (E) in FIG. 6. With the use of the noble metal portion 6, its flake-resistant property is significantly improved with relatively low cost as evidenced by FIG. 5, it is sufficiently enough to put the spark plug into practical use as long as the molten alloy layer 62 contains the component of the clad metal 44 by 80% or less.

As apparent from the foregoing description, the noble metal portion is maintained generally in flush with the outer surface of the electrode, thus making it possible to keep a uniform spark gap interval with a low cost upon putting it to mass production.

Further, the noble metal portion has the molten alloy layer 62 which contains the component of the clad metal, thus making it possible to effectively prevent the development and growth of the cracks at the welding portion or in the neighborhood of the welding portion so as to conducive to a long service life.

It is noted that the insulator 3 may be made by ceramic material with A1N as a main component.

Further, it is also appreciated that the ground electrode 1 may be made in integral with the front end of the metallic shell 2.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A method of making a ground electrode for a spark plug having a discharge gap, said method comprising:

preparing an electrode blank having a firing portion at one end of the electrode blank;

providing a recess at the firing portion of the electrode blank to be facing the discharge gap;

placing a noble metal material in the recess such that the noble metal material has a surface to be facing the discharge gap; and applying laser beams on the noble metal material in the recess to melt 70%~100% by weight of the noble metal material so as to form a noble metal tip, wherein the laser beams are directed to the surface of the noble metal material to be facing the discharge gap, wherein a component of the electrode blank is formed from a clad metal, wherein the clad metal is thermally fused to the noble metal tip to form a fused portion, such that the clad metal comprises 0.5%~80% of the total weight of the fused portion, and the melted noble metal material in the recess is substantially flush with an outer surface of the electrode.

2. A method of making a ground electrode as recited in claim 1, wherein the noble metal material is in powder form and completely melts.

3. A method of making a ground electrode as recited in claim 1 or 2 wherein the volume of the recess corresponds substantially to the volume of the noble metal material.

4. A method of making a ground electrode as recited in claim 1 or 2 wherein the noble metal material is one selected from the group consisting of Pt, It, Pt-Ni alloy, Pt-It alloy and Ir-based alloy containing oxide of rare earth metals.

5. A method of making a ground electrode as recited in claim 1 or 2 wherein the electrode blank has a clad metal and heat-conductive core embedded in the clad metal.

6. A method of making a ground electrode as recited in claim 3, wherein the noble metal material in one selected from the group consisting of Pt, Ir, Pt-Ni alloy, Pt-Ir alloy and Ir-based alloy containing oxide of rare earth metals.

7. A method of making a ground electrode as recited in claim 3, wherein the electrode blank has a clad metal and a heat-conductive core embedded in the clad metal.

* * * * *